US011305925B2

(12) United States Patent
Figgins

(10) Patent No.: US 11,305,925 B2
(45) Date of Patent: Apr. 19, 2022

(54) SURFACE PATTERNED FLANGE FOR PACKING CONTAINER

(71) Applicant: Sonoco Plastics, Inc., Hartsville, SC (US)

(72) Inventor: Travis Figgins, Wesley Chapel, FL (US)

(73) Assignee: Sonoco Plastics, Inc., Hartsville, SC (US)

( * ) Notice: Subject to any disclaimer, the term of this patent is extended or adjusted under 35 U.S.C. 154(b) by 70 days.

(21) Appl. No.: 15/925,602

(22) Filed: Mar. 19, 2018

(65) Prior Publication Data

US 2019/0283949 A1 Sep. 19, 2019

(51) Int. Cl.

| | |
|---|---|
| ***B65D 77/20*** | (2006.01) |
| ***B65D 43/16*** | (2006.01) |
| ***B65D 1/36*** | (2006.01) |
| ***B65D 21/02*** | (2006.01) |
| ***B65D 6/00*** | (2006.01) |

(52) U.S. Cl.

CPC ..... *B65D 77/2012* (2013.01); *B65D 1/36* (2013.01); *B65D 11/20* (2013.01); *B65D 21/0233* (2013.01); *B65D 43/169* (2013.01); *B65D 2543/00296* (2013.01)

(58) Field of Classification Search

CPC ..... B65D 43/08; B65D 85/34; B65D 43/162; B65D 77/2012; B65D 11/20; B65D 21/0233

USPC ..... 220/839, 4.23

See application file for complete search history.

(56) References Cited

U.S. PATENT DOCUMENTS

| | | | | |
|---|---|---|---|---|
| 3,615,039 | A | 10/1971 | Ward | |
| 6,126,013 | A | 10/2000 | Miller | |
| 6,149,053 | A | 11/2000 | Chatterton et al. | |
| 6,241,096 | B1 | 6/2001 | Littlejohn et al. | |
| 6,988,654 | B2 | 1/2006 | Wneck | |
| 7,017,775 | B2 | 3/2006 | Zettle et al. | |
| 8,777,010 | B2 | 7/2014 | Wneck | |
| 2007/0262487 | A1 | 11/2007 | O'Hagan et al. | |
| 2011/0048999 | A1 | 3/2011 | Wneck | |
| 2013/0095216 | A1* | 4/2013 | Pugh | B30B 15/022 426/392 |
| 2018/0016064 | A1* | 1/2018 | Lam | B65D 43/162 |

* cited by examiner

*Primary Examiner* — Jeffrey R Allen

(74) *Attorney, Agent, or Firm* — Fish & Richardson P.C.

(57) ABSTRACT

A container and a method for forming a container that has a base flange on a base, and a lid flange on a lid. One or both of the base flange and lid flange have a relief pattern. For each flange that has the relief pattern, the relief pattern imparts rigidity in the flange to resist flexure of the flange relative to the portion of the container (the base or lid) to which the flange is attached.

10 Claims, 6 Drawing Sheets

SURFACE PATTERNED FLANGE FOR PACKING CONTAINER

BACKGROUND

Many food products are stored and shipped in lightweight plastic containers. Typically, a plastic container is constructed to facilitate automated packaging of the food products. The containers are typically designed to be shipped from a manufacturer in a stacked arrangement. This stacked arrangement is also referred to as a "nested" arrangement.

When a food product is being packaged, a food packaging machine will separate a container from the nested arrangement. The process of separating nested containers is referred to as "denesting." Some denesting machines separate stacked food containers by engaging flanges that extend from portions of the containers. Additionally, during processing, the flanges of the food containers may also be manipulated by food packaging equipment.

SUMMARY

This specification describes technologies relating to relief patterns on peripheral flanges that extend from a body and a lid of a container, such as a food container.

In general, one innovative aspect of the subject matter described in this specification can be embodied in a container apparatus that includes a base section including base surface, base sidewalls extending upward from the base surface to define a base container portion having an upper base periphery that is opposite the base surface, and a base flange having an upper base flange surface and lower base flange surface opposite the upper base flange surface and projecting outward from the upper base periphery and including on at least one of the upper base flange surface or lower base flange surface a base relief pattern that imparts rigidity in the base flange to resist flexure of the base flange; a lid section, including: a lid surface, lid sidewalls extending downward from the lid surface to define a lid container portion having a lower lid periphery that is opposite the lid surface, and a lid flange having an upper lid flange surface and lower lid flange surface opposite the upper lid flange surface and projecting outward from the lower lid periphery and including on at least one of the upper lid flange surface or lower lid flange surface a lid relief pattern that imparts rigidity in the lid flange to resist flexure of the lid flange.

Another innovative aspect of the subject matter described in this specification can be embodied in a container apparatus that includes a container surface; container sidewalls extending from the container surface to define a container portion having a container periphery that is opposite the container surface; and a container flange having an upper container flange surface and lower container flange surface opposite the upper container flange surface and projecting outward from the container periphery and including on at least one of the upper container flange surface or lower container flange surface a relief pattern that imparts rigidity in the container flange to resist flexure of the container flange relative to the base periphery.

Another innovative aspect of the subject matter described in this specification can be embodied in method for forming a container apparatus that includes positioning within an etching apparatus a mold that is used to form a container apparatus, wherein the mold defines a container having a container surface, container sidewalls extending from the container surface to define a container portion having a container periphery that is opposite the container surface, and a container flange projecting outward from the container periphery; and etching, utilizing the etching apparatus, a surface portion of the mold that forms the container flange to form a mold relief pattern in the surface portion of the mold, wherein the mold relief pattern imparts a relief pattern in the container flange of the container apparatus that is formed by the mold, and wherein the relief pattern imparts rigidity in the container flange to resist flexure of the container flange relative to the base periphery.

Particular embodiments of the subject matter described in this specification can be implemented so as to realize one or more of the following advantages. The relief pattern imparts rigidity in the flange to resist flexure of the flange during denesting and handling. The added rigidity imparted by the relief pattern also makes the flanges less susceptible to damage than flanges that do not have such relief patterns.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements. Reference numerals in drawings subsequent to the drawings in which they are introduced may be omitted to avoid congestion in the drawings.

DETAILED DESCRIPTION

Figure 1:
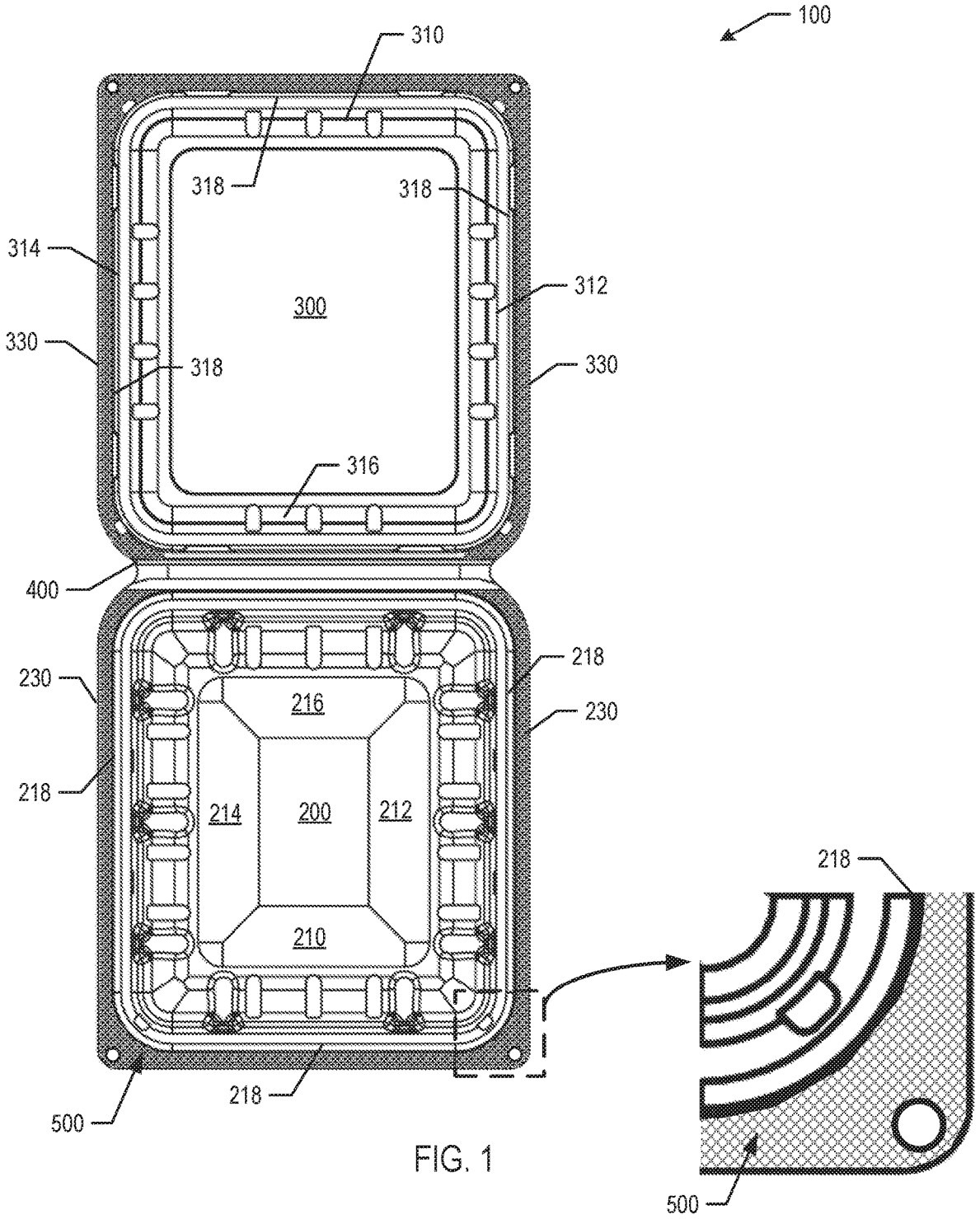
FIG. 1 is a top view of the container in an open positon and with detailed reference to a portion of base flange with a relief pattern.

FIGS. 1-4 provide illustrations of an example container apparatus 100 that includes a base section 200 and a lid section 300. The base section 200 and lid section 300 may be flexibly connected to each other, such as by a living hinge 400. Other hinge connections may also be used. Each of the base section 200 and lid section 300 include peripheral flanges, e.g., base flange 230 and lid flange 330. The actual dimensions of the interior of the container apparatus 100 is illustrative only, and the application of relief patterns 500 to the flanges 230 and 330 may be applied to containers that have shapes that are different from the shape of the container 100 of FIGS. 1-4.

In the example container 100 of FIGS. 1-4, the base section 200 includes a base surface 202, and base sidewalls 210, 212, 214 and 216 extending upward from the base surface 202 to define a base container portion having an upper base periphery 218 that is opposite the base surface 202. The base section 200 also includes a base flange 230 projecting outward from the upper base periphery 218 and generally outward relative to the base sidewalls 210, 212, 214 and 216. While the flange 230 is depicted as extending outward from the periphery 218 of the sidewalls 212, 214 and 216, the flange 230, in other container implementations, may extend from fewer sidewalls, such as from only the front sidewall 210.

The lid section 300 has a lid surface 302, and lid sidewalls 310, 312, 314 and 316 extending downward from the lid surface 302 to define a lid container portion having a lower lid periphery 318. The lid section 300 also includes a lid flange 330 that extends from the lower lid periphery 318 and generally outward relative to the lid sidewalls 310, 312, 314 and 316. Similar to the flange 230 of the base portion 200, the lid flange 330 is depicted as extending from the periphery 318 of sidewalls 310, 312, 314 and 316. Again, the flange 330, in other implementations, may extend from fewer sidewalls, such as from only the front sidewall 310.

Figure 2:
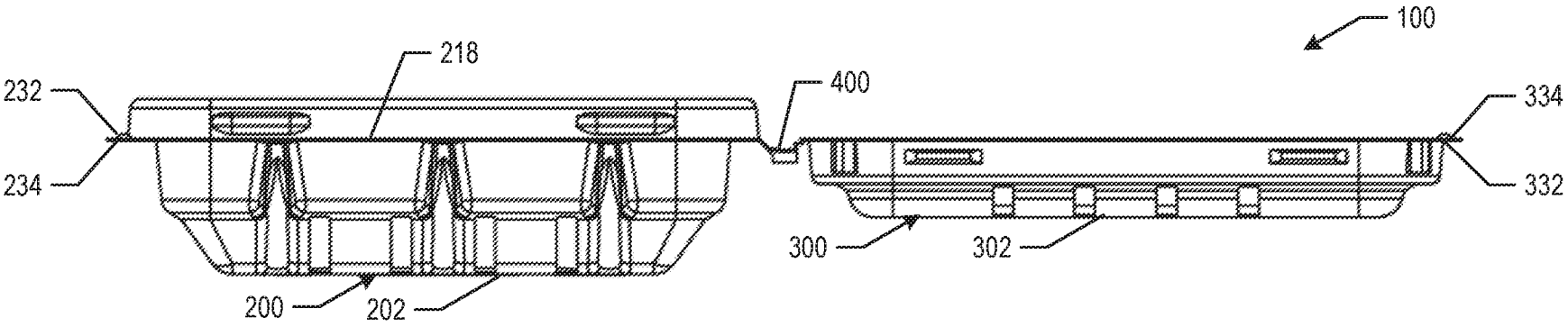
FIG. 2 is a side view of the container in the open position.

As shown in FIG. 2, the base flange 230 has an upper base flange surface 232 and a lower base flange surface 234. Likewise, the lid flange 330 has an upper lid flange surface 332 and a lower lid flange surface 334. Each flange has, on at least one of the respective upper flange surface or lower flange surface, a relief pattern 500 that imparts rigidity in the flange to resist flexure of the flange. The relief pattern 500 located on the upper base flange surface 232 is shown in detail in FIG. 1.

In some implementations, the relief pattern may be constructed such that the contours on the upper flange surface are reflections of the contours of the lower flange surface, e.g., at a particular cross-section location, where the relief pattern rises relative to the upper flange surface, the relief pattern likewise rises relative to the lower flange surface. In other implementations, the relief pattern may be constructed such that it has embossed-features where the contours on the upper flange surface are opposite the contours of the lower flange surface, e.g., at a particular cross-section location, where the relief pattern rises relative to the upper flange surface, the relief pattern lowers relative to the lower flange surface. In other implementations, the relief pattern may be present only on one of the flange surfaces and the opposite surface of the flange is flat. More generally, as used in this specification, a "relief pattern" is a pattern that is formed on at least one surface of a flange and that does not include overlapping folds of material that form the flange and that imparts rigidity in the flange to resist flexure of the flange during handling.

Adding rigidity to the flanges 230 and 330 results in a container 100 that is less susceptible to damage. The added rigidity also results in the container 100 the be less likely to cause machine handling errors when the container is being processed by use of the flanges 230 and 330 while in the open position, as shown in FIG. 3.

Figure 3:
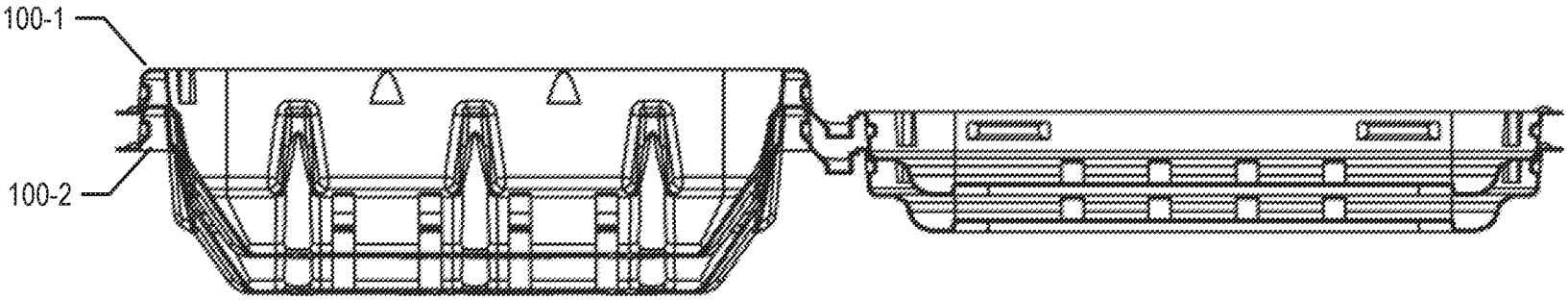
FIG. 3 is a side view of the containers in a stacked configuration.
Figure 4:
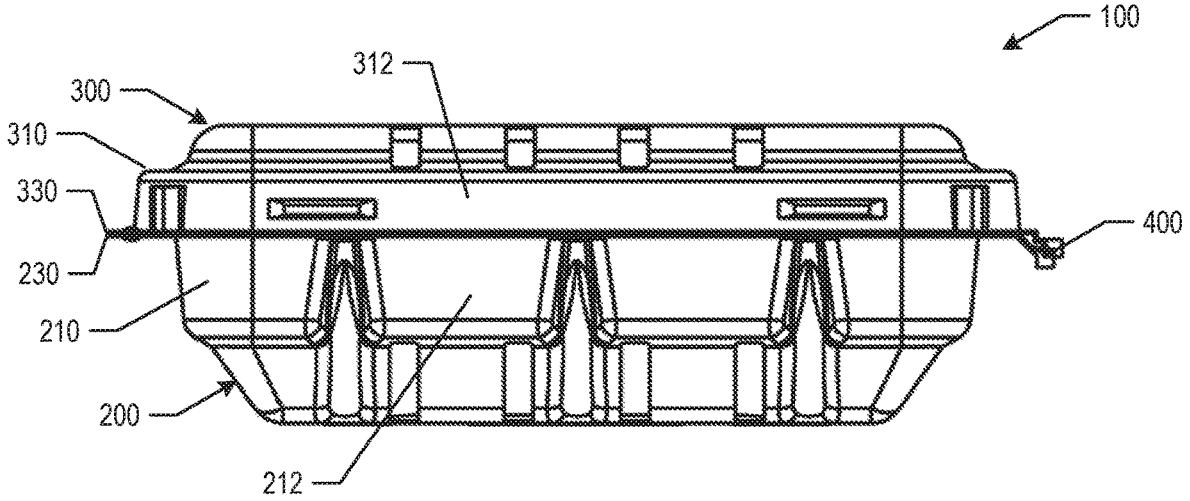
FIG. 4 is a side view of the container in a closed position.

Moreover, for containers 100 that are stackable, such that they can be stacked in the stacked configuration of FIG. 3, the added rigidity of the flanges 230 and 330 aids in denesting for denesting machines that denest by use of the flanges 230 and 330. When the containers are in an open position such as in FIG. 3, each container base section is operable to receive a like base section from above and to be received in a like base section from below. Likewise, the lid section is operable to receive a like lid section from above and to be received in a like lid section from below. By use of the flanges 230 and 330, a denesting machine may separate the containers 100.

Figure 5A:
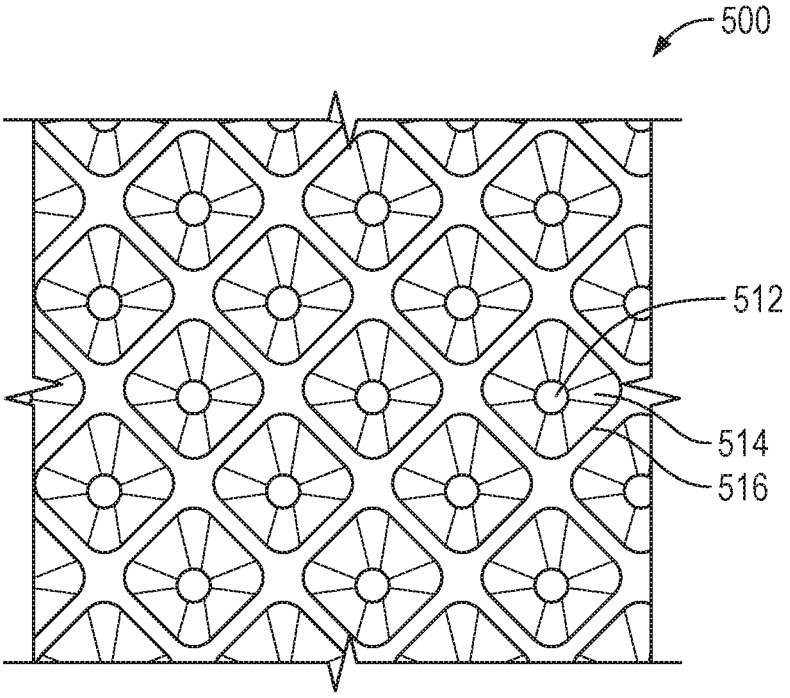
FIG. 5A-5D are illustrations of example surface relief patterns.

In FIG. 1, the relief pattern 500 is a diamond-shaped relief pattern in which diamond-shaped depressions are formed in a surface of a flange, e.g., in the upper surface 232 of the base flange 230 and the lower surface 334 of the lid flange 330. The relief pattern 500 is shown in more detail in FIG. 5A. As illustrated in FIG. 5A, the relief pattern 500 is formed by a series of depression surfaces 512 from which side surfaces 514 rise at angles to form ridges 516. The depression surfaces 512 are shaped such that the resulting diamond pattern shown in FIG. 5A is formed.

Figure 5B:
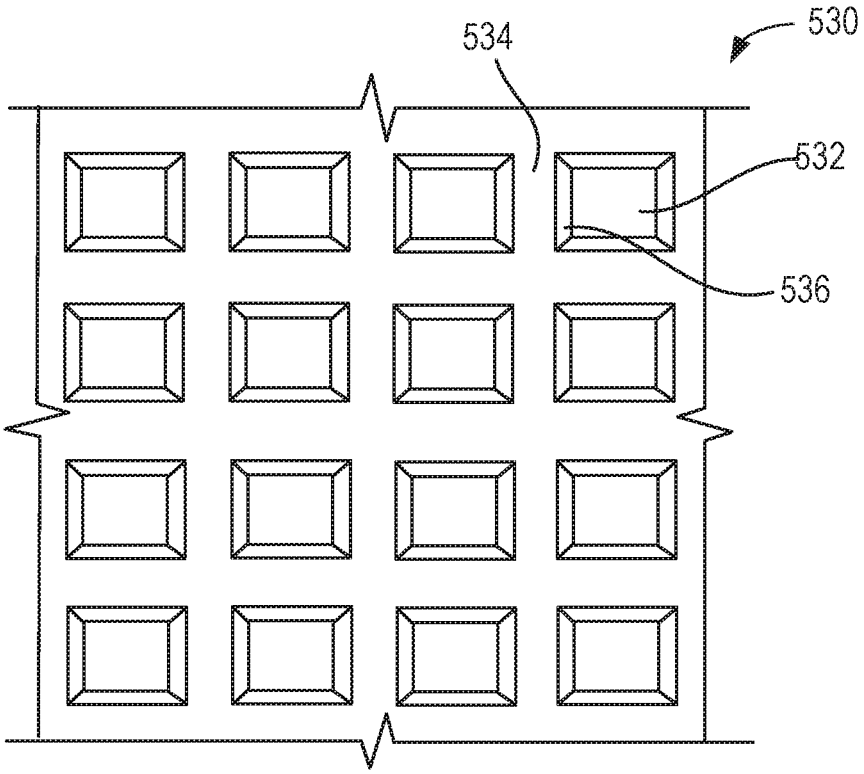
Figure 5C:
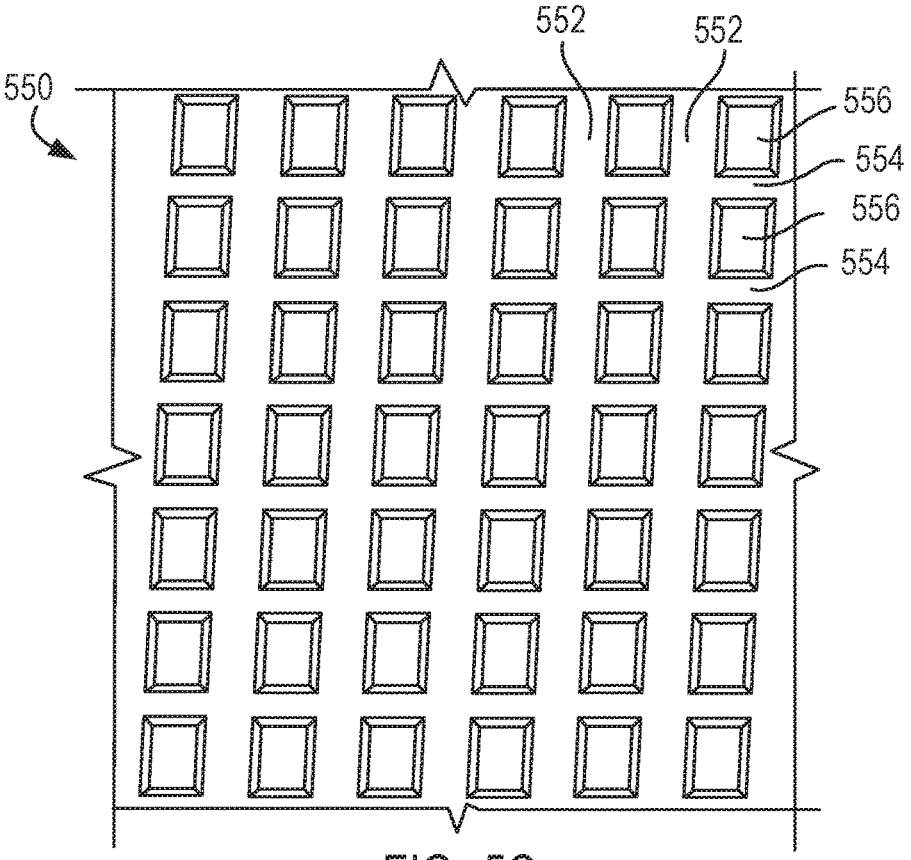
Figure 5D:
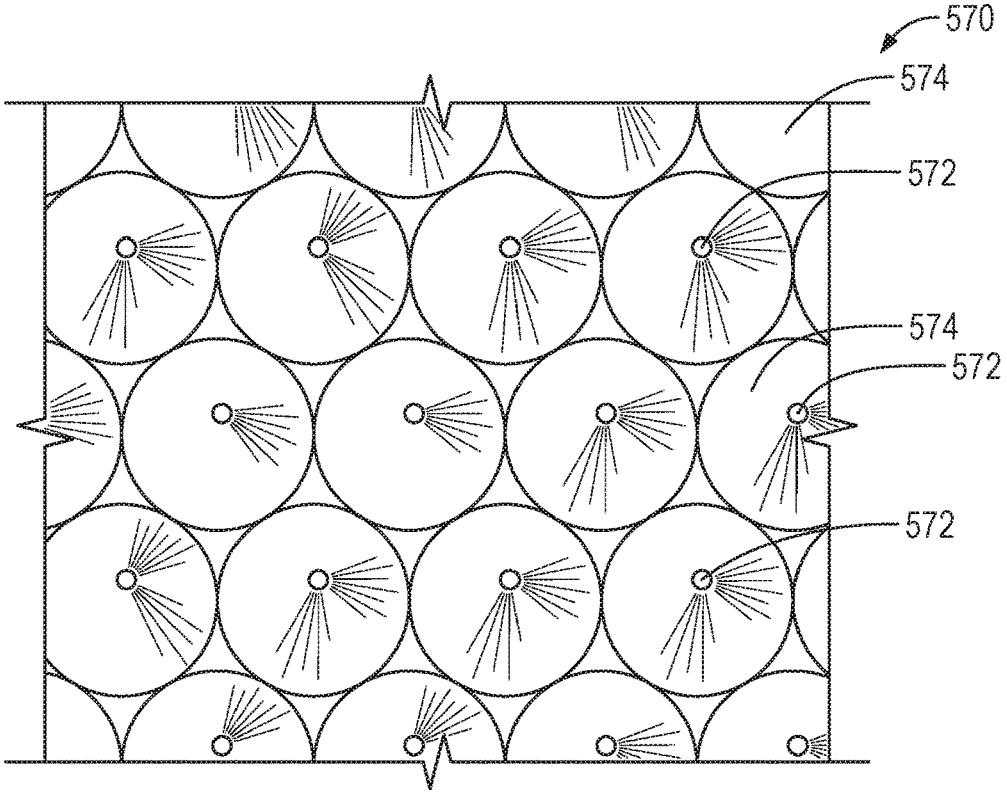

A variety of other relief patterns may also be used, some of which are shown in FIGS. 5B-5D. More generally, any relief pattern, which does not include overlapping folds of material in a flange 230 or 330, and that imparts rigidity in the flange 230 or 330, can be used. Example relief patterns include a rhombus relief pattern defining a plurality of rhombi, where each rhombus is positioned in the relief pattern to define parallel ridges. In some implementations, the parallel ridges are normal to at least one portion of the base periphery 218 and lid periphery 318. In other implementations, none of the parallel ridges is normal to any portion of the base periphery and lid periphery.

For example, FIG. 5B depicts a relief pattern 530 that includes multiple square depressions 532. Each side of a depression 532 rises abruptly to form a corresponding ridge 534.

Another relief pattern 550 is shown in FIG. 5C. The relief pattern 550 is formed by multiple parallel ridges 552 between which are transverse sub-ridges 554 that run perpendicular to the ridges 552, thus forming depressions 556.

The relief patterns need not be rhomboid-based. For example, the relief pattern 570 of FIG. 5D is a circular relief pattern defined by multiple raised circular features 572 that form depressions 574 at the periphery of each circular feature 572. The features 572 can also be scalloped-shaped to form a scalloped relief pattern. More generally, any oblong shape that imparts a stiffness may be used for a relief pattern.

In other implementations, a dimple relief pattern defined by multiple spaced apart circular or oval dimples may be used. The dimples may be position in the relief pattern to define parallel ridges that are normal to at least one portion of the base periphery and lid periphery.

The container 100 may be formed out of a variety of appropriate materials. In some implementations, the container 100 is made of polyethylene terephthalate (PET) thermoplastic polymer resin. The container 100 may be clear, or may be opaque. Furthermore, other plastic materials or even paper may also be used to form the container 100.

Figure 6:
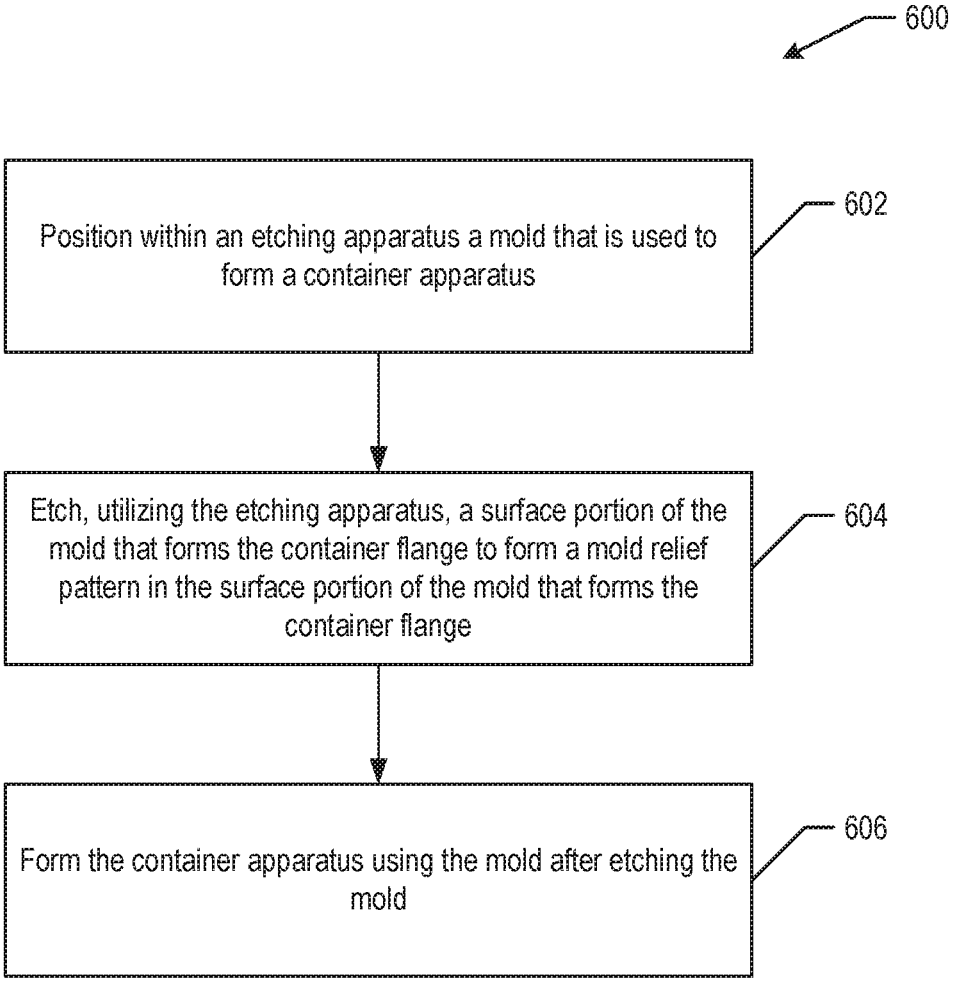
FIG. 6 is a flow chart for a process of forming a container apparatus with a relief pattern in flange.

Relief patterns may be formed in the flanges in a variety of ways. For example, the relief patterns may be embossed onto the flanges after the container is formed. In another implementation, the relief pattern is integrally formed in the flanges during formation of the container. Alternatively, the relief pattern may be laser-etched onto the flanges after the container is formed. For example, a mold that is used to form the container 100 may include the relief pattern in the flange portion of the mold. An example process for make such a mold and forming a container from such a mold is described with reference to FIG. 6, which is a flow chart for a process 600 of forming a container apparatus with a relief pattern in flange.

The process 600 positions, within an etching apparatus, a mold that is used to form a container apparatus (602). The mold may be a mold that is used in a vacuum forming process, or a mold that is used in another type of process to form the container apparatus. The mold defines a container surface, container sidewalls extending from the container surface to define a container portion having a container periphery that is opposite the container surface, and a container flange projecting outward from the container periphery.

The process 600 etches, utilizing the etching apparatus, a surface portion of the mold that forms the container flange to form a mold relief pattern in the surface portion of the mold that forms the container flange (604). The etching can be done, for example, by laser etching, or some other etching process. In some implementations, the mold relief pattern is etched to a depth D that is greater than a thickness T of a thermoplastic material that is used as the container apparatus material.

Figure 7:
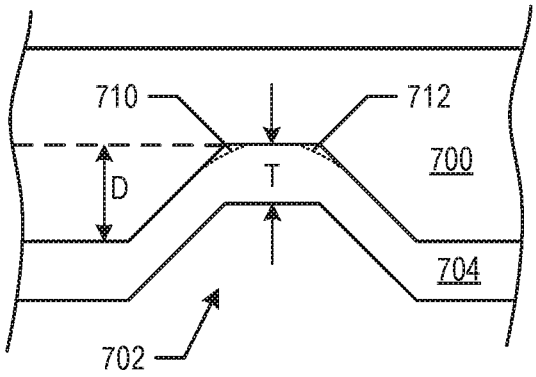
FIG. 7 is a cross-section view of a portion of a flange that is vacuum molded in a mold having an etched relief.

For example, as illustrated in FIG. 7, a mold 700 has been etched to a depth D to form a void 702 in a surface portion that is used to form a flange of a container. The depth D is greater than the thickness T of a material, such as the thermoplastic material 704, that is used to form the container. The depth D can vary to any appropriate depth. In some implementations, the depth D is at least 25% greater than the thickness T of the thermoplastic material. The depth D can also be limited to less than 60% greater than the thickness of the thermoplastic material.

Other depth-to-thickness ratios can also be used, and the depth can also be less than the thickness of the thermoplastic material. The depth necessary to impart the desired rigidity may depend on the particular relief pattern used.

The process 600 forms the container apparatus using the mold after etching the mold (606). For example, as shown in FIG. 7, the mold 700 is being used to form the container having a flange portion.

While the illustration of FIG. 7 depicts the thermoplastic material 704 having a contour that matches the mold 700, very often the thermoplastic material 704 will not exactly match the contours of the mold 700. For example, the thermoplastic material 704 may only fill the void 702 in the mold up to the curved portions 710 and 712. Moreover, depending on the dimensions of D and T and other geometries, the thermoplastic material 704 may not even come into contact with many portions of the mold 700; instead, the thermoplastic material 704 may have a relief pattern having contours that are induced by, but do not match, the mold 700. For example, in FIG. 7, the resulting cross-section in the thermoplastic material 704 may not be the frustoconical shape as depicted, but may instead be curved and without the defined angles as shown in FIG. 7.

While the containers described in this application include a lid portion and a base portion, the portions need not be integrally connected. For example, a base portion and a lid portion may be formed as separate components that are not connected to each other, and one or both may the peripheral flanges and relief patterns as described above.

While etching can be used as described above with reference to FIG. 6, in other implementations, the surface of the mold (or of the flanges after the container is formed) may undergo an abrasion process to impart a rough abrasion.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A container apparatus, comprising:

a base section including:

a base surface;

base sidewalls extending upward from the base surface to define a base container portion having an upper base periphery that is opposite the base surface; and a base flange having an upper base flange surface and lower base flange surface opposite the upper base flange surface and projecting outward from the upper base periphery and including on at least one of the upper base flange surface or lower base flange surface a base relief pattern that imparts rigidity in the base flange to resist flexure of the base flange;

a lid section, including:

a lid surface;

lid sidewalls extending downward from the lid surface to define a lid container portion having a lower lid periphery that is opposite the lid surface; and a lid flange having an upper lid flange surface and lower lid flange surface opposite the upper lid flange surface and projecting outward from the lower lid periphery and including on at least one of the upper lid flange surface or lower lid flange surface a lid relief pattern that imparts rigidity in the lid flange to resist flexure of the lid flange;

wherein:

when the container apparatus is in a closed position, the lower lid flange surface is in contact with the upper base flange surface; and the base relief pattern and the lid relief pattern are positions respect to each other such that at a particular cross section location, the contours of the relief patterns are opposite so that when a rise that occurs in the base relief pattern relative to the upper base flange surface, a lowering occurs in the lid relief pattern relative to the lower lid flange surface.

2. The container apparatus of claim 1, wherein when the container is in an open position the base section is operable to receive a like base section from a received container apparatus from above and to be received in a like base section in a receiving container apparatus from below, and the lid section is operable to receive a like lid section from the received container apparatus from above and to be received in a like lid section in the receiving container apparatus from below.

3. The container apparatus of claim 1, wherein the base section is flexibly coupled to the lid section along a back base sidewall that is opposite a front base sidewall.

4. The container apparatus of claim 1, wherein the base relief pattern and the lid relief pattern are a same relief pattern.

5. The container apparatus of claim 1, wherein the relief pattern defines a plurality of perpendicular ridges.

6. The container apparatus of claim 1, wherein the relief pattern defines a plurality of parallel ridges.

7. The container apparatus of claim 1, wherein the relief pattern is molded into the base flange and lid flange after the container apparatus is formed.

8. The container apparatus of claim 1, wherein the relief pattern is etched onto the base flange and lid flange after the container apparatus is formed.

9. The container apparatus of claim 1, wherein the relief pattern is embossed onto the base flange and lid flange after the container apparatus is formed.

10. The container apparatus of claim 1, wherein the relief pattern defines contours having a depth that is at least 25% greater than a thickness of a vertical cross section of the flange.

* * * * *